US010309100B2

(12) United States Patent
Long et al.

(10) Patent No.: US 10,309,100 B2
(45) Date of Patent: Jun. 4, 2019

(54) MULLION COVER HANGER AND CURTAIN WALL INSULATION SYSTEM INCORPORATING THE SAME

(71) Applicant: Owens Corning Intellectual Capital, LLC, Toledo, OH (US)

(72) Inventors: Jack Long, Warsaw, IN (US); Saul Salgado, Warsaw, IN (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 15/835,936

(22) Filed: Dec. 8, 2017

(65) Prior Publication Data

US 2018/0163397 A1 Jun. 14, 2018

Related U.S. Application Data

(60) Provisional application No. 62/432,260, filed on Dec. 9, 2016.

(51) Int. Cl.

| | |
|---|---|
| ***E04B 2/88*** | (2006.01) |
| ***E04B 1/94*** | (2006.01) |
| ***E04B 2/96*** | (2006.01) |

(52) U.S. Cl.

CPC ..... *E04B 1/941* (2013.01); *E04B 2/96* (2013.01); *E04B 1/94* (2013.01)

(58) Field of Classification Search

CPC .... Y10S 52/06; Y10S 411/921; Y10S 411/92; F16B 15/0038; F16B 15/0046; E04B 2/88; E04B 2001/7679; E04B 1/7666; E04B 1/946

See application file for complete search history.

(56) References Cited

U.S. PATENT DOCUMENTS

| | | | | | |
|---|---|---|---|---|---|
| 717,923 | A | | 1/1903 | Rapp | |
| 1,535,220 | A | | 4/1925 | Gallagher | |
| 1,755,538 | A | * | 4/1930 | Draughon, Jr. | E04D 5/142 411/457 |
| 1,782,695 | A | | 11/1930 | Prez | |
| 2,047,386 | A | | 7/1936 | Schreiber | |
| 2,400,266 | A | * | 5/1946 | Soffer | F16B 15/0038 217/69 |
| 2,533,786 | A | * | 12/1950 | Gagnier | B60R 13/0206 16/384 |
| 3,011,226 | A | * | 12/1961 | Menge | F16B 15/0046 411/466 |
| 3,892,396 | A | | 7/1975 | Monaghan | |
| 3,967,524 | A | * | 7/1976 | Snow | E04F 13/0835 411/461 |
| 4,471,592 | A | | 9/1984 | MacKinnon et al. | |
| 4,512,130 | A | * | 4/1985 | Pepin | E04B 1/7666 411/466 |
| 4,653,241 | A | | 3/1987 | Bindi | |

(Continued)

*Primary Examiner* — Brian E Glessner
*Assistant Examiner* — Daniel J Kenny
(74) *Attorney, Agent, or Firm* — Calfee, Halter & Griswold LLP

(57) ABSTRACT

A mullion cover hanger and a curtain wall insulation system incorporating the mullion cover hanger are provided. The mullion cover hanger includes an elongated main body having hook members extending therefrom. When the mullion cover hanger is attached to a mullion, a mullion cover can be secured to the mullion cover hanger without using electric tools or additional fasteners.

11 Claims, 7 Drawing Sheets

(56) References Cited

U.S. PATENT DOCUMENTS

| | | | | |
|---|---|---|---|---|
| 4,761,928 | A | 8/1988 | Pichette | |
| 4,918,893 | A | 4/1990 | Vandenbroucke et al. | |
| 4,932,187 | A | 6/1990 | Kraemer et al. | |
| 5,060,441 | A | 10/1991 | Pichette | |
| 5,299,403 | A | 4/1994 | Fentz | |
| 5,701,709 | A | 12/1997 | Dixon | |
| 6,299,378 | B1 | 10/2001 | Griffith | |
| 7,424,793 | B1 | 9/2008 | Shriver | |
| 7,765,753 | B1 | 8/2010 | Shriver | |
| 7,886,491 | B1 | 2/2011 | Shriver | |
| 8,657,244 | B2 * | 2/2014 | Sillik | E04D 13/1625 248/217.3 |
| 8,683,763 | B2 | 4/2014 | Shriver | |
| 8,763,330 | B2 | 7/2014 | Pollack | |
| 8,844,230 | B2 | 9/2014 | Harkins | |
| 9,016,014 | B2 | 4/2015 | Shriver | |
| 9,163,411 | B2 | 10/2015 | Brady | |
| 9,441,371 | B1 | 9/2016 | Harkins | |

* cited by examiner

MULLION COVER HANGER AND CURTAIN WALL INSULATION SYSTEM INCORPORATING THE SAME

CROSS-REFERENCE TO RELATED APPLICATIONS

This application claims priority to and the benefit of U.S. Provisional Patent Application No. 62/432,260, filed Dec. 9, 2016, the entire content of which is incorporated by reference herein.

FIELD

The general inventive concepts relate to insulation systems for preventing a fire from moving between adjacent floors of a building and, more particularly, to a mullion cover hanger and curtain wall insulation systems incorporating the same.

BACKGROUND

Curtain wall insulation systems are commonly used to insulate adjacent floors of buildings that include curtain wall structures. In particular, the curtain wall insulation systems are used to provide thermal insulation and to inhibit the spread of fire from one floor to an upper adjacent floor through perimeter voids between an edge of a floor slab and the exterior building structure, which is sometimes referred to as the safing slot area.

A curtain wall structure is a non-load bearing type of exterior wall system that is utilized on buildings, such as high-rise buildings. The curtain wall structures generally utilize lightweight materials and often include metal skins. Conventional curtain wall structures include vertical framing members, referred to as mullions, and horizontal framing members, referred to as transoms. The mullions and transoms are typically hollow box-shaped members formed of aluminum. Curtain wall structures also include spandrel panels to provide an exterior facing thereof and are commonly made of glass, aluminum, thin sheets of foam material, and the like. Some curtain wall structures may also include an interior panel, commonly referred to as a backpan, that spans the area between the mullions and transoms and is recessed from the interior facing surfaces of the mullions and transoms to accommodate curtain wall insulation.

Curtain wall insulation systems generally include insulation that covers the aluminum mullions (mullion covers) to protect the mullions from direct exposure to extreme heat conditions such as during a fire, which could otherwise cause the mullions to soften, or even melt, and lose structural integrity. Mullion covers are typically installed using spiral anchors, cup head weld pins, or oversized vertical hangers with cooperating locking washers. Spiral anchors and cup head weld pins require the installer to use electric tools, such as a power drill or a capacitor discharge stud welder, to install the mullion covers. Vertical hangers with cooperating locking washers require the installer to press the mullion cover over the hangers, which cause the hangers to impale and extend through the mullion cover, and to secure the mullion cover to the hanger by placing a locking washer over the portion of the hanger that extends through the mullion cover. These means for installing mullions cover are inefficient with respect to the installer's time, and impractical for installing mullion covers in tight or otherwise obstructed spaces where an electric tool or an installer cannot easily gain access.

SUMMARY

The general inventive concepts relate to and contemplate a mullion cover hanger and a curtain wall insulation system that incorporates the mullion cover hanger. To illustrate various aspects of the general inventive concepts, several exemplary embodiments of mullion cover hangers and curtain wall insulation systems that incorporate the mullion cover hangers are disclosed.

In one exemplary embodiment, a mullion cover hanger for attaching a mullion cover to a mullion is provided. The mullion cover hanger includes an elongated main body having a top surface, a bottom surface, a first side edge, and a second side edge. The mullion cover hanger also includes a plurality of hook members extending outward relative to the top surface of the elongated main body.

In certain exemplary embodiments, the hook members are spaced vertically along the elongated main body. In certain exemplary embodiments, the hook members are arranged in a plurality of rows that are spaced vertically along the elongated main body. In certain exemplary embodiments, each row includes one hook member. In certain exemplary embodiment, each row includes at least two hook members.

In certain exemplary embodiments, the plurality of hook members extend outward relative to the top surface of the elongated main body so as to form an angle between each hook member and the top surface of the elongated main body. In certain exemplary embodiments, the angel between each hook member and the top surface of the elongated main body is at least 45°. In certain exemplary embodiments, the angel between each hook member and the top surface of the elongated main body is 90°.

In certain exemplary embodiments, the plurality of hook members extend outward from the top surface of the elongated main body. In certain exemplary embodiments, a first plurality of hook members are positioned at the first side edge of the elongated main body and a second plurality of hook members are positioned at the second side edge of the elongated main body.

In certain exemplary embodiments, the hook members are defined by: an upper edge that extends outward from the top surface at a first angle from the horizontal; a lower edge that extends outward from the top surface at a second angle from the horizontal; a topmost edge; and a hook edge. The upper edge of the hook member terminates at the hook edge of the hook member, the lower edge of the hook member terminates at the topmost edge of the hook member, the topmost edge of the hook member extends toward the top surface of the elongated main body and terminates at the hook edge of the hook member, and the first angle is less than the second angle. In certain exemplary embodiments, the first angle is from 0° to 50° and the second angle is from 20° to 70°. In certain exemplary embodiments, the hook members extend outward from the top surface of the elongated main body by a distance of 2 inches or less, including a distance of 1.5 inches or less.

In certain exemplary embodiments, the mullion cover hanger further comprises at least one fastening aperture that extends from the top surface of the elongated main body through the bottom surface of the elongated main body. In certain exemplary embodiments, the mullion cover hanger further comprises multiple fastening apertures that extend from the top surface of the elongated main body through the bottom surface of the elongated main body.

In one exemplary embodiment, a curtain wall insulation system for insulating a curtain wall structure connected to a building structure is provided. The curtain wall structure is spaced from a floor slab of the building structure to define a perimeter void. The curtain wall structure includes framing defined by at least first and second vertically disposed and parallel mullions, at least one upper horizontally disposed transom, and at least one lower horizontally disposed transom. The curtain wall insulation system includes a curtain wall insulation disposed within the framing and mechanically attached to the framing. The curtain wall insulation system also includes a safing insulation disposed within the perimeter void and compression fit between the curtain wall insulation and the floor slab. In addition, the curtain wall insulation system includes a mullion cover hanger attached to the mullions. The mullion cover hanger includes an elongated main body having a top surface, a bottom surface, a first side edge, a second side edge, and a plurality of hook members extending outward relative to the top surface of the elongated main body. A mullion cover is attached to the mullion cover hanger.

In certain exemplary embodiments of the curtain wall insulation system, a lower mullion cover is attached to the mullion cover hanger such that a top surface of the lower mullion cover abuts a bottom surface of the safing insulation, and an upper mullion cover is attached to the mullion cover hanger such that a bottom surface of the upper mullion cover abuts a top surface of the safing insulation.

In certain exemplary embodiments of the curtain wall insulation system, the curtain wall insulation system also includes a reinforcement member that is attached to the mullions, disposed between the mullions and behind the curtain wall insulation, and positioned at a level corresponding to a level of the safing insulation.

BRIEF DESCRIPTION OF THE DRAWINGS

The general inventive concepts, as well as embodiments and advantages thereof, are described below in greater detail, by way of example, with reference to the drawings in which.

DETAILED DESCRIPTION

Figure 1:
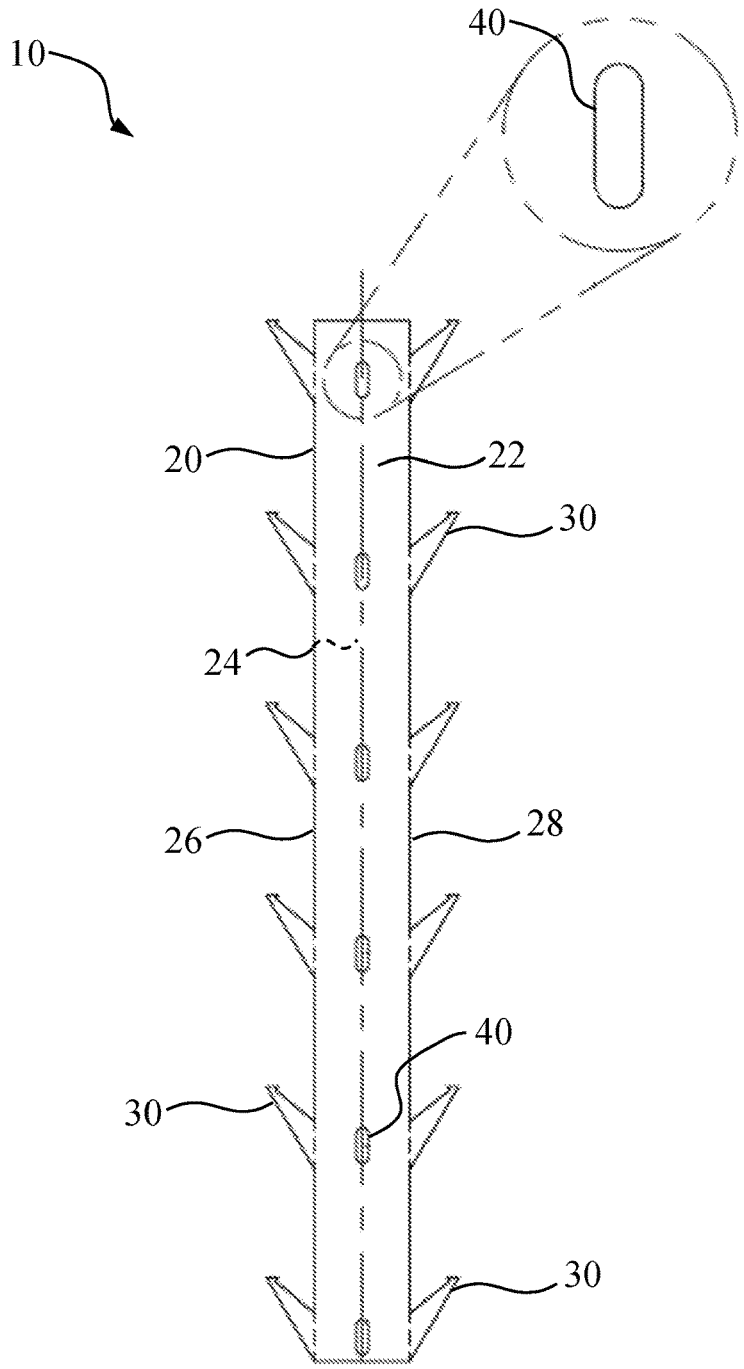
FIG. 1 is a front elevation view of a general shape of a mullion cover hanger prior to its hook members being bent to extend outward relative to a top surface of the main body of the mullion cover hanger, which includes a detailed view of an embodiment of a fastening aperture of the mullion cover hanger.

While the general inventive concepts are susceptible of embodiment in many different forms, there are shown in the drawings, and will be described herein in detail, specific embodiments thereof with the understanding that the present disclosure is to be considered as an exemplification of the principles of the general inventive concepts. Accordingly, the general inventive concepts are not intended to be limited to the specific embodiments illustrated herein.

The terminology as set forth herein is for description of the embodiments only and should not be construed as limiting the disclosure as a whole. All references to singular characteristics or limitations of the present disclosure shall include the corresponding plural characteristic or limitation, and vice versa, unless otherwise specified or clearly implied to the contrary by the context in which the reference is made. Unless otherwise specified, "a," "an," "the," and "at least one" are used interchangeably. Furthermore, as used in the description and the appended claims, the singular forms "a," "an," and "the" are inclusive of their plural forms, unless the context clearly indicates otherwise.

Figure 2:
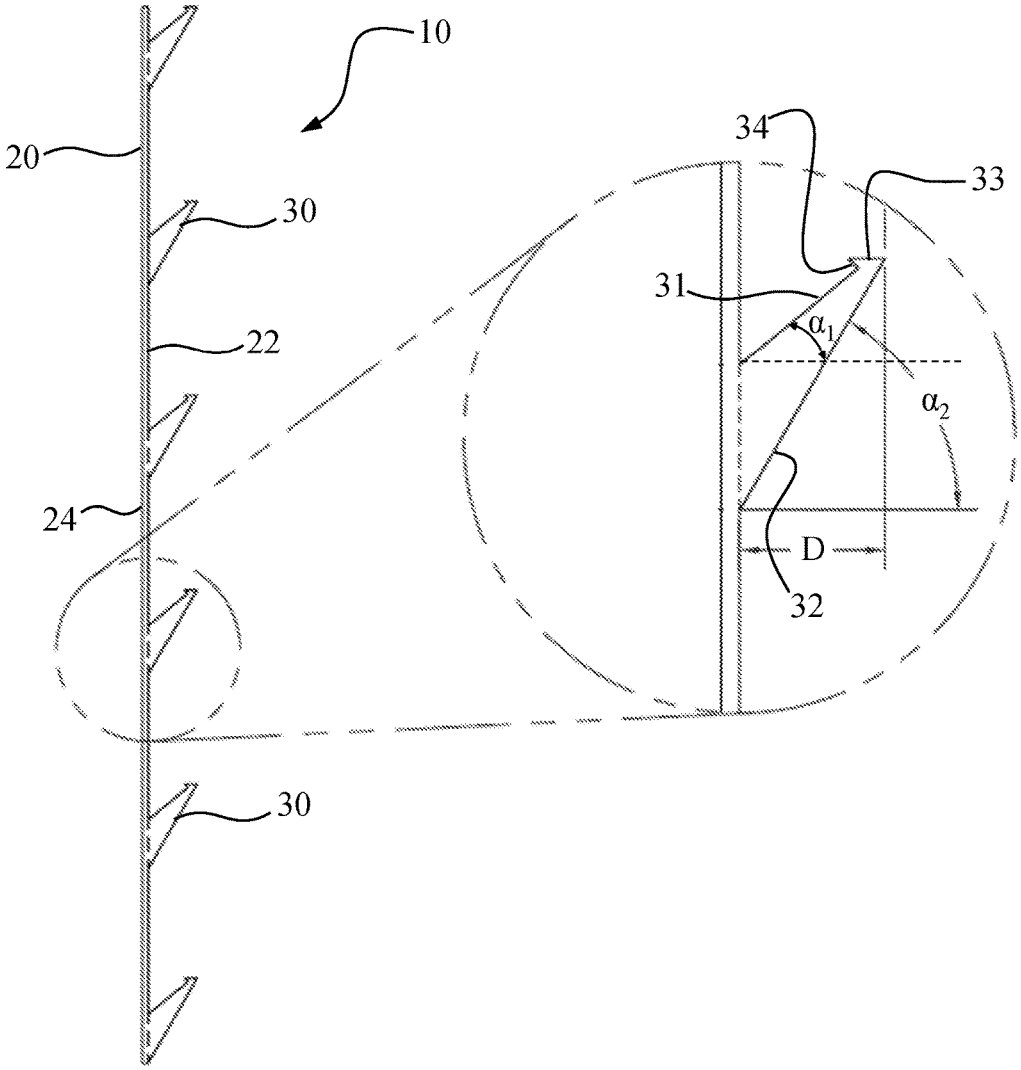
FIG. 2 is a side elevation view of an embodiment of a mullion cover hanger, which includes a detailed view of an embodiment of a hook member of the mullion cover hanger.

Referring to FIGS. 1 and 2, a mullion cover hanger 10, according to one exemplary embodiment, is shown. The mullion cover hanger 10 is useful for attaching a mullion cover to a mullion without using electric tools or additional fasteners, as will be described in more detail below. The mullion cover hanger 10 has an elongated main body 20, which may have a generally rectangular shape, as shown in FIG. 1. The elongated main body 20 has a top surface 22, a bottom surface 24, a first side edge 26, and an opposing second side edge 28. The top and bottom surfaces 22, 24 are generally flat so that the elongated main body 20 can be attached flush to a mullion.

The mullion cover hanger 10 also includes a plurality of hook members 30 that extend from the elongated main body 20, as seen in FIG. 2. In FIG. 1, the hook members 30 are shown in a flat state (i.e., on the same plane as the elongated main body 20) purely for illustration purposes. The hook members 30 in their operative position are shown in FIG. 2. The hook members 30 are configured for attaching and retaining a mullion cover when the mullion cover hanger 10 is installed on a mullion. As shown in FIG. 2, the plurality of hook members 30 extend outward relative to the top surface 22 of the elongated main body 20. In the exemplary embodiment illustrated in FIG. 2, the hook members 30 are defined by an upper edge 31 that extends outward relative to the top surface 22 of the elongated main body 20 at a first angle $\alpha_1$ from the horizontal, a lower edge 32 that extends outward relative to the top surface 22 of the elongated main body 20 at a second angle $\alpha_2$ from the horizontal, a topmost edge 33, and a hook edge 34. With continued reference to FIG. 2, the upper edge 31 terminates at the hook edge 34, the lower edge 32 terminates at the topmost edge 33, the topmost edge 33 extends toward the top surface 22 of the elongated main body 20 and terminates at the hook edge 34, and the first angle $\alpha_1$ is less than the second angle $\alpha_2$. In general, the hook members 30 have a generally triangular shape with at least one tooth or barb that extends toward the top surface 22 of the elongated main body 20.

As can be appreciated from FIG. 2, the first angle $\alpha_1$ and the second angle $\alpha_2$ define the extent to which the hook member 30 is vertically inclined. In certain embodiments, the first angle $\alpha_1$ is from 0° to 50°, including from 0° to 45°, from 0° to 30°, and also including 0° to 15°. When the first angle $\alpha_1$ is 0°, the upper edge 31 extends outward perpendicularly to the top surface 22. In certain embodiments, the second angle $\alpha_2$ is from 20° to 70°, including from 25° to 70°, from 45° to 70°, and also including from 50° to 70°. In certain embodiments, the first angle $\alpha_1$ is from 0° to 15° and the second angle $\alpha_2$ is from 20° to 40°. In certain embodiments, the first angle $\alpha_1$ is from 30° to 50° and the second angle $\alpha_2$ is from 50° to 70°.

With continued reference to FIG. 2, the hook members 30 extend outward from the top surface 22 of the elongated main body 20 by a distance D. The distance D may be any suitable distance and will typically be determined based on the thickness of the mullion cover being attached to the mullion cover hanger 10. In certain embodiments, the distance D to which the hook members extend outward from the top surface 22 of the elongated main body 20 is 2 inches or less, including 1.5 inches or less, and also including 1 inch or less. In certain embodiments, the distance D to which the hook members extend outward from the top surface 22 of the elongated main body 20 is equal to half of the thickness of the mullion cover being attach to the mullion cover hanger. For example, if a 2 inch thick mullion cover is being attached to the mullion cover hanger 10, the distance D to which the hook members extend outward from the top surface 22 of the elongated main body 20 would be 1 inch.

The hook members 30 may be arranged on, and with respect to, the elongated main body 20 in a variety of ways. In certain embodiments, the hook members 30 are spaced vertically along the elongated main body, as shown in FIGS. 1 and 2. In certain embodiments, the hook members 30 are arranged in a plurality of rows that are spaced vertically along the elongated main body, as seen in FIG. 1. In certain embodiments, each row includes at least two hook members 30, as shown in FIG. 1. However, it is contemplated that each row may consist of one hook member 30.

Figure 5A:
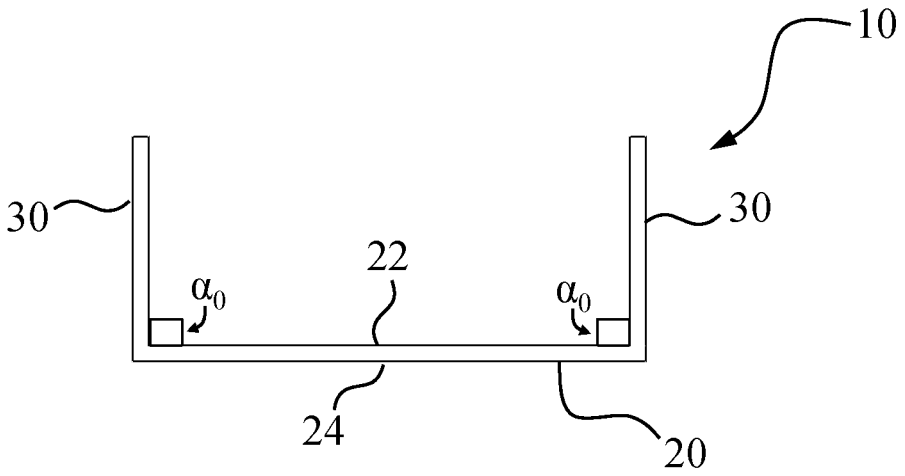
FIG. 5A is a top plan view of an embodiment of a mullion cover hanger.
Figure 5B:
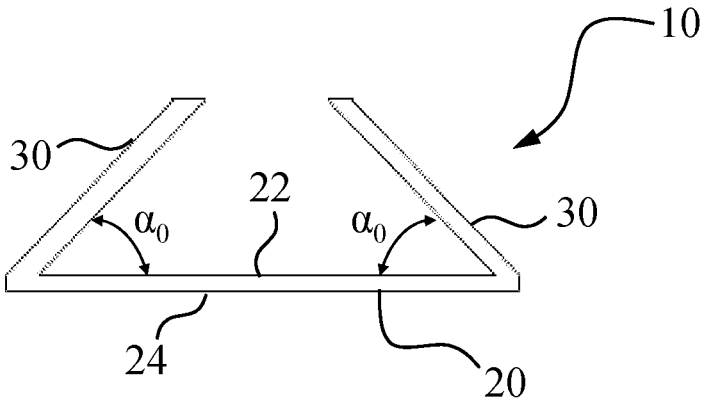
FIG. 5B is a top plan view of an embodiment of a mullion cover hanger.

With reference now to FIGS. 5A and 5B, the plurality of hook members 30, in certain embodiments, extend outward relative to the top surface 22 of the elongated main body 20 so as to form an angle $\alpha_0$ between each hook member 30 and the top surface 22 of the elongated main body 20. In certain embodiments, and as shown in FIG. 5A, the angle $\alpha_0$ between each hook member 30 and the top surface 22 of the elongated main body 20 is 90°. In certain embodiments, and as shown in FIG. 5B, the angle $\alpha_0$ between each hook member 30 and the top surface 22 of the elongated main body 20 is at least 45°. In certain embodiments, the angle $\alpha_0$ between each hook member 30 and the top surface 22 of the elongated main body 20 is from 45° to 89°. Embodiments in which the angle $\alpha_0$ between each hook member 30 and the top surface 22 of the elongated main body 20 is at least 45° and less than 90° may provide an advantage in that the mullion cover hanger 10 could fit into smaller spaces than would be possible if the angle $\alpha_0$ was 90°.

In certain embodiments, the hook members 30 extend outward from the top surface 22 of the elongated main body 20. In certain embodiments, the hook members 30 extend outward from the top surface 22 of the elongated main body 20 and are positioned between the first and second side edges 26, 28 of the elongated main body 20. The hook members 30 may be integrally formed on the top surface 22 of the elongated main body 20. Alternatively, the hook members 30 may be joined or otherwise affixed to the top surface of the elongated main body 20, for example, by welding.

As seen in FIG. 1, in certain embodiments, a first plurality of hook members 30 are positioned at the first side edge 26 of the elongated main body 20 and a second plurality of hook members 30 are positioned at the opposing second side edge 28 of the elongated main body 20. In certain embodiments, the hook members 30 positioned at the first side edge 26 of the elongated main body 20 are spaced equidistantly along the length of the elongated main body 20, and the hook members 30 positioned at the second side edge 28 of the elongated main body 20 are spaced equidistantly along the length of the elongated main body 20. In certain embodiments, each hook member 30 positioned at the first side edge 26 of the elongated main body 20 is parallel to a hook member 30 positioned at the second side edge 28 of the elongated main body 20, as shown in FIG. 1. In certain embodiments, each hook member 30 positioned at the first side edge 26 of the elongated main body 20 is not parallel to (i.e., is vertically offset from) a hook member 30 positioned at the second side edge 28 of the elongated main body 20. In certain embodiments, the first plurality of hook members 30 and the second plurality of hook members 30 are arranged in a plurality of rows spaced vertically along the elongated main body 20, with each row including a hook member 30 from the first plurality of hook members 30 (i.e., a hook member 30 positioned at the first side edge 26) and a hook member 30 from the second plurality of hook members 30 (i.e., a hook member 30 positioned at the second side edge 28), as seen in FIG. 1. In certain embodiments, the first plurality of hook members 30 positioned at the first side edge 26 of the elongated main body 20 are vertically offset with respect to the second plurality of hook members 30 positioned at the second side edge 28 of the elongated main body 20. The hook members 30 positioned at the first or second side edges 26, 28 of the elongated main body may be integrally formed with the first and second side edges 26, 28 of the elongated main body 20. Alternatively, the hook members 30 may be joined or otherwise affixed to the first and second side edges 26, 28 of the elongated main body, for example, by welding.

With continued reference to FIG. 1, the mullion cover hanger 10, in certain embodiments, includes at least one fastening aperture 40 that extends from the top surface 22 of the elongated main 20 body through the bottom surface 24 of the elongated main body 20. The fastening aperture 40 provides positioning for a fastener, such as a screw, through the mullion cover hanger 10 to the mullion, as well as provides a bearing surface for a fastener. In certain embodiments, the mullion cover hanger 10 includes at least two fastening apertures 40. By providing a mullion cover hanger 10 with at least two fastening apertures 40, an installer has the ability to fasten or otherwise attach the mullion cover hanger 10 to a mullion at a point above a floor slab and at a point below the floor slab. Such a configuration is advantageous in situations where the floor slab is deep or where there are any other obstructions (e.g., a beam) that could hinder the ability of the installer to fasten or otherwise attach the mullion cover hanger 10 to the mullion. It is also contemplated that the mullion cover hanger 10 could be welded to the mullion, which would not require fastening apertures or fasteners to attach the mullion cover hanger 10 to a mullion.

The fastening aperture 40 may be arranged on the elongated main body 20 and with respect to the hook members 30 in a variety of ways. In certain embodiments, at least one fastening aperture 40 is positioned between horizontally adjacent hook members 30 (i.e., a hook member 30 positioned on the first side edge 26 and a hook member 30 positioned on the second side edge 28), as shown in FIG. 1. In certain other embodiments, at least one fastening aperture 40 is positioned between vertically adjacent hook members 30. In certain embodiments, at least one fastening aperture 40 is positioned along a centerline of the elongated main body 20, as shown in FIG. 1. In certain embodiments, at least one fastening aperture 40 is positioned between the first side edge 26 and the centerline of the elongated main body 20. In certain embodiments, at least one fastening aperture 40 is positioned between the second side edge 28 and the centerline of the elongated main body 20.

The mullion cover hanger 10 may be formed from a variety of materials. Preferably, the mullion cover hanger 10 is formed of a metal including, but not limited to, steel, galvanized steel, brass, and aluminum. Ceramic materials may also be used to form the mullion cover hanger 10. In certain embodiments, the mullion cover hanger 10 is formed of galvanized steel, and preferably 20 gauge galvanized steel. The mullion cover hanger 10 may be manufactured using a conventional stamping process in which, for example, a sheet of 20 gauge galvanized steel is pressed between a tool and die to form the general shape of the mullion cover hanger 10, as shown in a front elevation view in FIG. 1. The mullion cover hanger 10 shown in FIG. 1 may then be subjected to another stamping process in which the hook members 30 are bent to extend outward relative to the top surface 22 of the elongated main body 20, for example at an angle of 90°, as shown in a top plan view in FIG. 5A.

Figure 6:
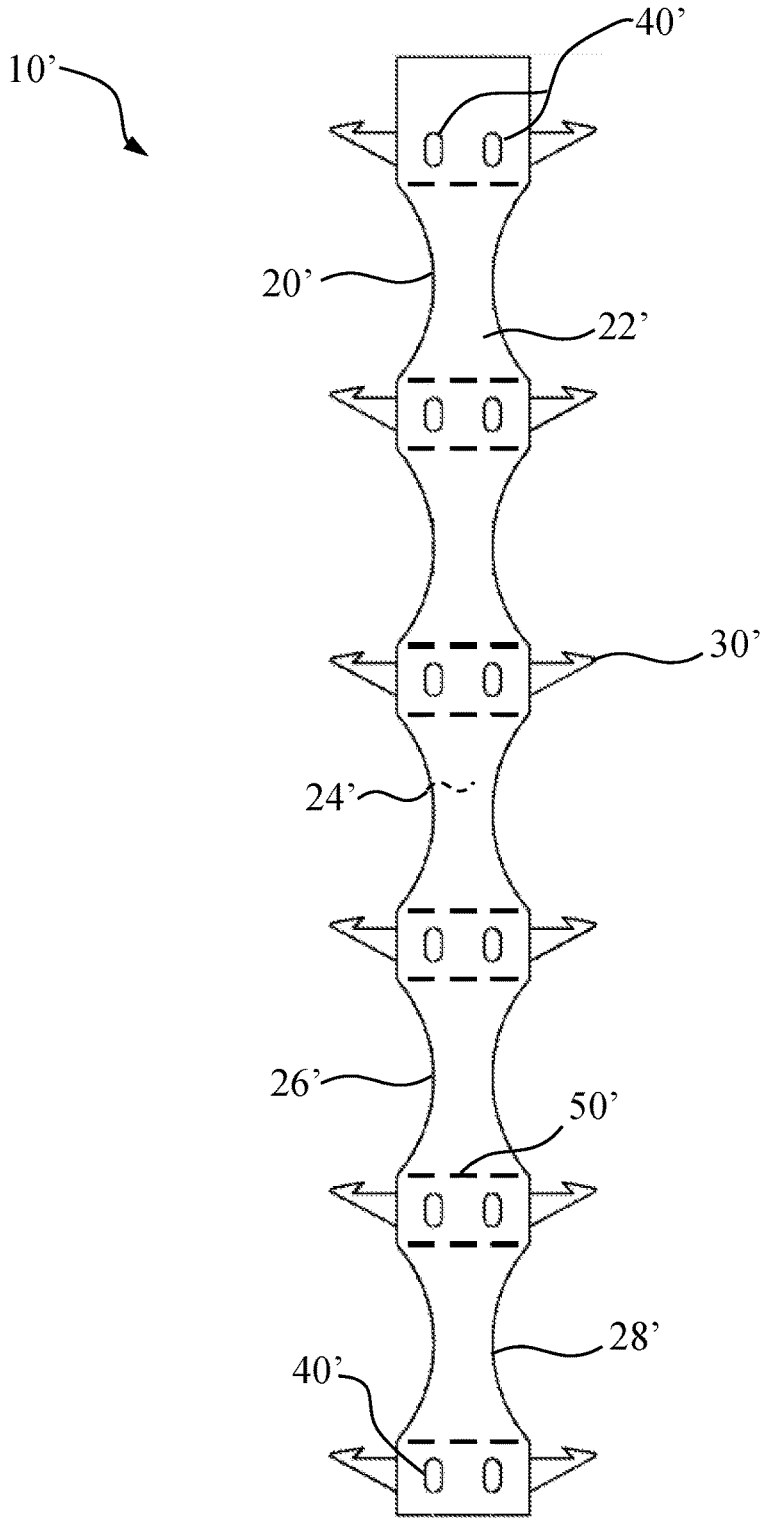
FIG. 6 is a front elevation view of a general shape of a mullion cover hanger prior to its hook members being bent to extend outward relative to a top surface of the main body of the mullion cover hanger.
Figure 7:
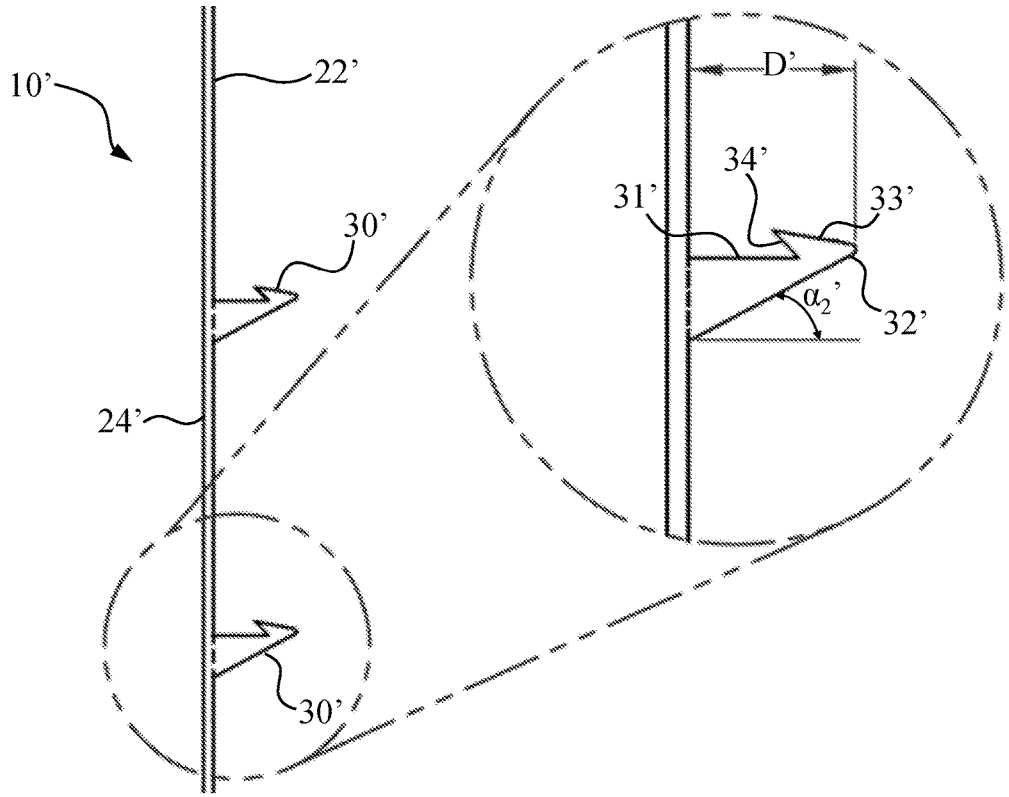
FIG. 7 is a side elevation view of an embodiment of a mullion cover hanger, which includes a detailed view of an embodiment of a hook member of the mullion cover hanger.

Referring now to FIGS. 6 and 7, a mullion cover hanger 10', according to one exemplary embodiment, is shown. The mullion cover hanger 10' has an elongated main body 20', which has a top surface 22', a bottom surface 24', a first side edge 26', and an opposing second side edge 28'. The top and bottom surfaces 22', 24' are generally flat so that the elongated main body 20 can be attached flush to a mullion. As seen in FIG. 6, the first and second side edges 26', 28' include at least one concavity. The concavities reduce the amount of material required to form the mullion cover hanger 10'. Furthermore, mullions may include protruding hardware, such as screw heads or bolt heads, which can prevent the mullion cover hanger 10' from being attached flush to the mullion. The concavities can be formed along the first and second side edges 26', 28' so that the mullion cover hanger 10' avoids contact with protruding hardware to allow flush attachment to the mullion.

The mullion cover hanger 10' also includes a plurality of hook members 30' that extend from the elongated main body 20', as seen in FIG. 7. In FIG. 6, the hook members 30' are shown in a flat state (i.e., on the same plane as the elongated main body 20') purely for illustration purposes. The hook members 30' in their operative position are shown in FIG. 7. The hook members 30' are configured for attaching and retaining a mullion cover when the mullion cover hanger 10' is installed on a mullion. As shown in FIG. 7, the plurality of hook members 30' extend outward relative to the top surface 22' of the elongated main body 20'. In the exemplary embodiment illustrated in FIG. 7, the hook members 30' are defined by an upper edge 31' that extends outward perpendicularly to the top surface 22' of the elongated main body 20' (i.e., at a first angle $\alpha_1'$ (not shown) of 0° from the horizontal), a lower edge 32' that extends outward relative to the top surface 22' of the elongated main body 20' at a second angle $\alpha_2'$ from the horizontal, a topmost edge 33', and a hook edge 34'. With continued reference to FIG. 7, the upper edge 31' terminates at the hook edge 34', the lower edge 32' terminates at the topmost edge 33', the topmost edge 33' extends toward the top surface 22' of the elongated main body 20' and terminates at the hook edge 34', and the first angle $\alpha_1'$ (in FIG. 7, $\alpha_1'$ is 0° and is not shown) is less than the second angle $\alpha_2'$. In general, the hook members 30' have a generally triangular shape with at least one tooth or barb that extends toward the top surface 22' of the elongated main body 20'. In certain embodiments, the portion at which the lower edge 32' terminates at the topmost edge 33' is rounded. The rounded portion where the lower edge 32' and topmost edge 33' meet reduces the likelihood that the hook members 30' would impale an installer handling the mullion cover hanger 10'.

With continued reference to FIG. 7, the hook members 30' extend outward from the top surface 22' of the elongated main body 20' by a distance D'. The distance D' may be any suitable distance and will typically be determined based on the thickness of the mullion cover being attached to the mullion cover hanger 10'. In certain embodiments, the distance D' to which the hook members 30' extend outward from the top surface 22' of the elongated main body 20' is 2 inches or less, including 1.5 inches or less, and also including 1 inch or less. In certain embodiments, the distance D' to which the hook members 30' extend outward from the top surface 22' of the elongated main body 20' is equal to half of the thickness of the mullion cover being attached to the mullion cover hanger 10'. For example, if a 2 inch thick mullion cover is being attached to the mullion cover hanger 10', the distance D' to which the hook members 30' extend outward from the top surface 22' of the elongated main body 20' would be 1 inch.

The hook members 30' may be arranged on, and with respect to, the elongated main body 20' in a variety of ways. In certain embodiments, the hook members 30' are spaced vertically along the elongated main body, as shown in FIGS. 6 and 7. In certain embodiments, the hook members 30' are arranged in a plurality of rows that are spaced vertically along the elongated main body 20', as seen in FIG. 6. In certain embodiments, each row includes two hook members 30', as shown in FIG. 6. However, it is contemplated that each row may consist of one hook member 30'.

In certain embodiments, the hook members 30' extend outward from the top surface 22' of the elongated main body 20'. In certain embodiments, the hook members 30' extend outward from the top surface 22' of the elongated main body 20' and are positioned between the first and second side edges 26', 28' of the elongated main body 20'. The hook members 30' may be integrally formed on the top surface 22' of the elongated main body 20'. Alternatively, the hook members 30' may be joined or otherwise affixed to the top surface 22' of the elongated main body 20', for example, by welding.

As seen in FIG. 6, in certain embodiments, a first plurality of hook members 30' are positioned at the first side edge 26' of the elongated main body 20' and a second plurality of hook members 30' are positioned at the opposing second side edge 28' of the elongated main body 20'. In certain embodiments, the hook members 30' positioned at the first side edge 26' of the elongated main body 20' are spaced equidistantly along the length of the elongated main body 20', and the hook members 30' positioned at the second side edge 28' of the elongated main body 20' are spaced equidistantly along the length of the elongated main body 20'. In certain embodiments, each hook member 30' positioned at the first side edge 26' of the elongated main body 20' is parallel to a hook member 30' positioned at the second side edge 28' of the elongated main body 20', as shown in FIG. 6. In certain embodiments, each hook member 30' positioned at the first side edge 26' of the elongated main body 20' is not parallel to (i.e., is vertically offset from) a hook member 30' positioned at the second side edge 28' of the elongated main body 20'. In certain embodiments, the first plurality of hook members 30' and the second plurality of hook members 30' are arranged in a plurality of rows spaced vertically along the elongated main body 20', with each row including a hook member 30' from the first plurality of hook members 30' (i.e., a hook member 30' positioned at the first side edge 26') and a hook member 30' from the second plurality of hook members 30' (i.e., a hook member 30' positioned at the second side edge 28'), as seen in FIG. 6. In certain embodiments, the first plurality of hook members 30' positioned at the first side edge 26' of the elongated main body 20' are vertically offset with respect to the second plurality of hook members 30' positioned at the second side edge 28' of the elongated main body 20'. The hook members 30' positioned at the first or second side edges 26', 28' of the elongated main body may be integrally formed with the first and second side edges 26', 28' of the elongated main body 20'. Alternatively, the hook members 30' may be joined or otherwise affixed to the first and second side edges 26', 28' of the elongated main body, for example, by welding.

With continued reference to FIG. 6, embodiments of the mullion cover hanger 10' may include a plurality of pairs of fastening apertures 40', with each fastening aperture 40' extending from the top surface 22' of the elongated main body 20' through the bottom surface 24' of the elongated main body 20'. Each fastening aperture 40' of the pair of fastening apertures 40' is positioned between the first side edge 26' and the second side edge 28' and are horizontally aligned and spaced apart from one another. In certain embodiments, the fastening apertures 40' of the pair of fastening apertures 40' may be spaced apart by ½ inch to 1 inch. By providing a mullion cover hanger 10' with a plurality of pairs of fastening apertures 40', as shown in FIG. 6, the mullion cover hanger 10' can be installed effectively on mullions that include a slip joint. Mullions that include a slip joint, or two mullions that are positioned side by side, are configured to move relative to one another. The pairs of horizontally aligned and spaced apart fastening apertures 40' allow the mullion cover hanger 10' to be attached to a mullion along one side of the slip joint so that the attached mullion cover hanger 10' does not impede relative movement of the mullion.

As seen in FIG. 6, embodiments of the mullion cover hanger 10' may include one or more lines of reduced strength 50' on the elongated main body 20'. The line of reduced strength 50' may be configured in a variety of ways. In certain embodiments, as seen in FIG. 6, the line of reduced strength 50' is configured as a series of perforations that extend through the elongated main body 20'. In certain embodiments, the line of reduced strength 50' is configured as a continuous score line formed in the top surface 22', the bottom surface 24', or both the top and bottom surfaces 22', 24'. In certain embodiments, the line of reduced strength 50' is configured as a discontinuous score line formed in the top surface 22', the bottom surface 24', or both the top and bottom surfaces 22', 24'. The line of reduced strength 50' may be formed in a variety of ways including, but not limited to, a stamping process or an etching process.

In certain embodiments, a line of reduced strength 50' is positioned above and below the fastening apertures 40' along the length of the main body 20', as seen in FIG. 6. The line of reduced strength 50' may be positioned above and below the fastening apertures 40' by a distance of 0.125 inch to 0.5 inch, including from 0.1875 inch to 0.3125 inch, and also including from 0.1875 to 0.25 inch. The lines of reduced strength 50' allow installers to reduce the length of the mullion cover hanger 10' by using their hands to bend the hanger 10' back and forth along a selected line of reduced strength 50' until the hanger 10' separates at the selected line of reduced strength 50'. Accordingly, the lines of reduced strength 50' allow for customization of the mullion cover hanger 10' by an installer in the field without having to use a tool, such as a saw or other cutting devices.

The mullion cover hanger 10' may be formed from a variety of materials. Preferably, the mullion cover hanger 10' is formed of a metal including, but not limited to, steel, galvanized steel, brass, and aluminum. Ceramic materials may also be used to form the mullion cover hanger 10'. In certain embodiments, the mullion cover hanger 10' is formed of galvanized steel, and preferably 20 gauge galvanized steel. The mullion cover hanger 10' may be manufactured using a conventional stamping process in which, for example, a sheet of 20 gauge galvanized steel is pressed between a tool and die to form the general shape of the mullion cover hanger 10', as shown in the front elevation view of FIG. 6. The mullion cover hanger 10' shown in FIG. 6 may then be subjected to another stamping process in which the hook members 30' are bent to extend outward relative to the top surface 22' of the elongated main body 20', for example, at an angle of 90°.

Figure 3:
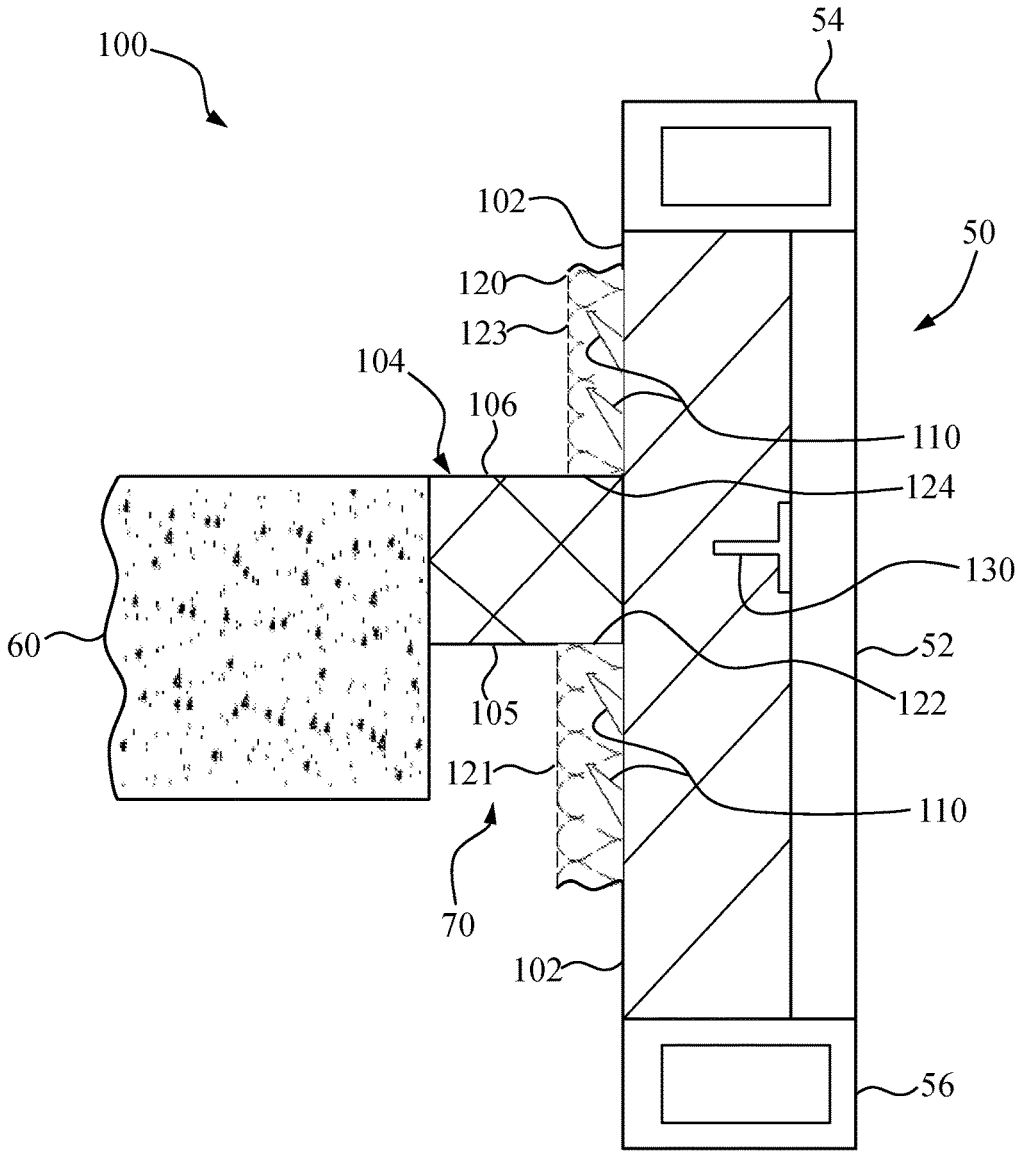
FIG. 3 is a side sectional view of an embodiment of a curtain wall insulation system.

Referring now to FIG. 3, a curtain wall insulation system 100, according to one exemplary embodiment, is shown. The curtain wall insulation system 100 is useful for insulating a curtain wall structure 50 connected to a building structure (not shown). As one of skill in the art will appreciate, a curtain wall structure 50 is a type of exterior wall system commonly used on buildings, such as high-rise buildings, wherein the curtain wall structure 50 does not bear the load of the building structure. As see in FIG. 3, the curtain wall structure 50 is spaced from a floor slab 60 of the building structure to define a perimeter void 70. The curtain wall structure 50 includes framing defined by at least first and second vertically disposed and parallel mullions 52, at least one upper horizontally disposed transom 54, and at least one lower horizontally disposed transom 56. The curtain wall insulation system 100 provides thermal insulation and also provides a barrier to inhibit the spread of fire from one floor of a building to an upper adjacent floor through the perimeter void 70.

With continued reference to FIG. 3, the curtain wall insulation system 100 includes a curtain wall insulation 102. The curtain wall insulation 102 may be formed of various materials based on a desired failure temperature of the material such as mineral wool, which can maintain its integrity for more than five hours at temperatures of nearly 2,100° F. Such curtain wall insulation 102 is commercially available from Thermafiber, Inc. (Wabash, Ind.). The curtain wall insulation 102 may have a thickness of 1 inch to 8 inches, and a density of 4 pounds per cubic foot to 8 pounds per cubic foot. The curtain wall insulation 102 is disposed within the framing and mechanically attached to the framing. Accordingly, the size and shape of the curtain wall insulation 102 will typically depend on the size and shape of the framing into which the curtain wall insulation 102 is being installed. The curtain wall insulation 102 may be mechanically attached to the framing with insulation hangers (not shown), such as Impasse® insulation hangers available from Thermafiber, Inc. (Wabash, Ind.), or by other conventional means used to mechanically attach curtain wall insulation 102 to the framing, such as impaling pins or screws.

As shown in FIG. 3, the curtain wall insulation system 100 also includes a safing insulation 104 having a bottom surface 105 and a top surface 106. The safing insulation 104 is disposed within the perimeter void 70 and compression fit between the curtain wall insulation 102 and the floor slab 60. The safing insulation 104 inhibits flames and hot gases from moving from a first floor to an adjacent upper floor through the perimeter void 70. As with the curtain wall insulation 102, the safing insulation 104 may be formed of various materials based on a desired failure temperature of the material. In certain embodiments, the safing insulation 104 comprises mineral wool. The safing insulation 104 may have a thickness of 1 inch to 8 inches, and a density of 4 pounds per cubic foot to 8 pounds per cubic foot. Such safing insulation 104 is commercially available from Thermafiber, Inc. (Wabash, Ind.). When installed, the safing insulation 104 is commonly compressed to varying degrees, but normally it is compressed to approximately 25%. After installation, the safing insulation 104 provides fireproof sealing of the perimeter void 70. Because the safing insulation 104 is compressed when installed, it provides some capability to expand which can seal openings or cracks that might otherwise develop in the perimeter void 70. Slight variations in the size of the perimeter void 70 due to expansion or other environmental changes are accommodated by the safing insulation 104 since it is compressed when placed in the perimeter void 70, and thus can provide an effective seal under various conditions.

In certain embodiments, the curtain wall insulation system 100 includes a reinforcement member 130 attached to and disposed between the mullions 52 and behind the curtain wall insulation 102. The reinforcement member 130 is positioned at a level corresponding to a level of the safing insulation 104, which level is commonly referred to as the safing line. The reinforcement member 130 prevents bowing or deformation of the curtain wall insulation 102 due to the compression fit of the safing insulation 104. The reinforcement member 130 may have various shapes or configurations. For example, the reinforcement member may have a T-shape, as shown in FIG. 3, an L-shape, or may be formed as a channel (e.g., C-shaped channel, U-shaped channel). Brackets (not shown) may be used to attach the reinforcement member 130 to the mullions 52. The reinforcement member 130 may be formed of various materials including, but not limited to, steel, galvanized steel, ceramics, and other heat resistant materials.

As shown in FIG. 3, the curtain wall insulation system 100 includes a mullion cover hanger 110 that is attached to the mullions 52 and a mullion cover 120 that is attached to the mullion cover hanger 110. The mullion cover hanger 110 may have any of the configurations or features described herein and shown in FIGS. 1, 2, 5A, 5B, 6, 7, and 8. The mullion cover 120 protects the mullions 52 from hot flames and gases during a fire. The mullion cover 120 may be formed of various materials based on a desired failure temperature of the material. In certain embodiments, the mullion cover 120 comprises mineral wool. The mullion cover 120 may have a thickness of 1 inch to 8 inches, and a density of 4 pounds per cubic foot to 8 pounds per cubic foot. Such mullion covers 120 are commercially available from Thermafiber, Inc. (Wabash, Ind.).

In certain embodiments, and as shown in FIG. 3, the curtain insulation system 100 includes a lower mullion cover 121 attached to the mullion cover hanger 110, and an upper mullion cover 123 attached to the mullion cover hanger 110. The lower mullion cover 121 is installed so that a top surface 122 of the lower mullion cover 121 will abut a bottom surface 105 of the installed safing insulation 104. Similarly, the upper mullion cover 123 is installed so that a bottom surface 124 of the upper mullion cover 123 will abut a top surface 106 of the installed safing insulation 104. This configuration provides an effective seal of insulation that inhibits hot flames and gases from reaching the mullions 52.

Figure 4C:
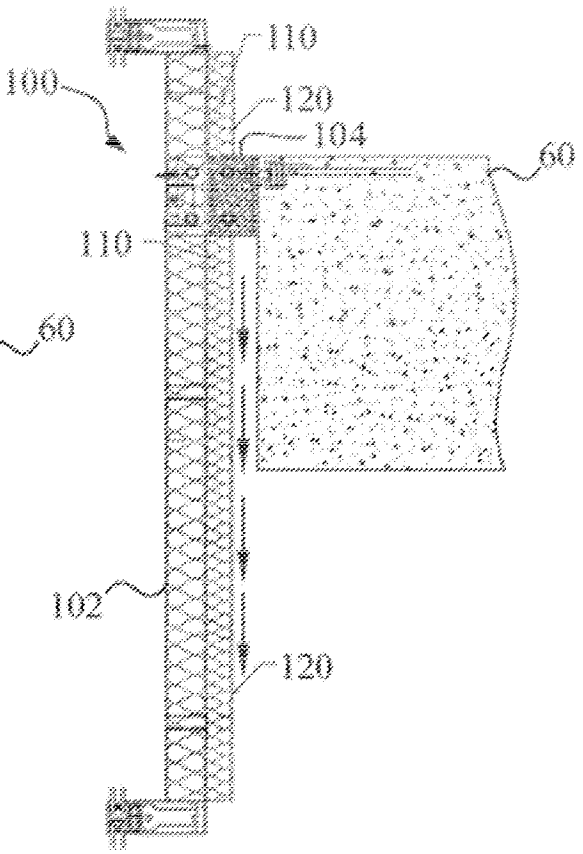
FIG. 4C is a side sectional view of an embodiment of a curtain wall insulation system, which illustrates a third step of installing the mullion cover on the mullion cover hanger.
Figure 4B:
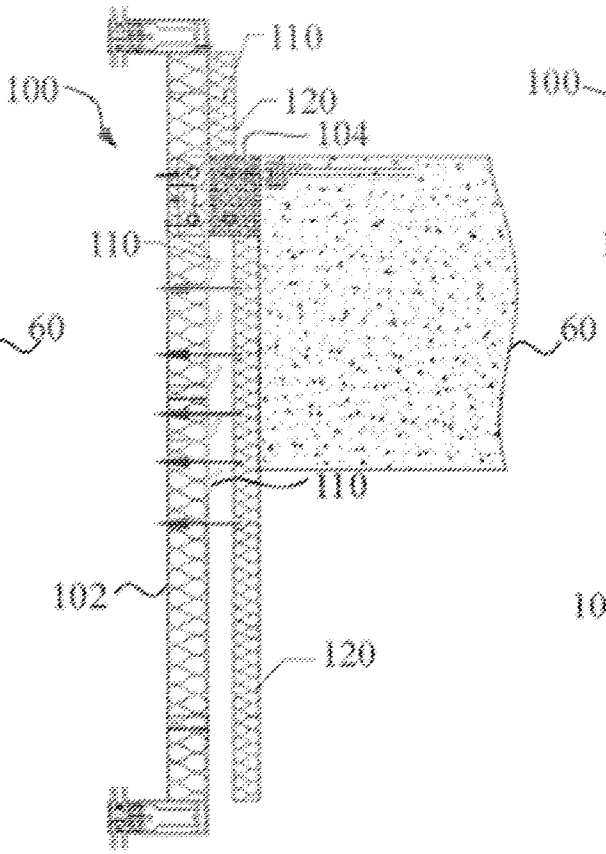
FIG. 4B is a side sectional view of an embodiment of a curtain wall insulation system, which illustrates a second step of installing the mullion cover on the mullion cover hanger.
Figure 4A:
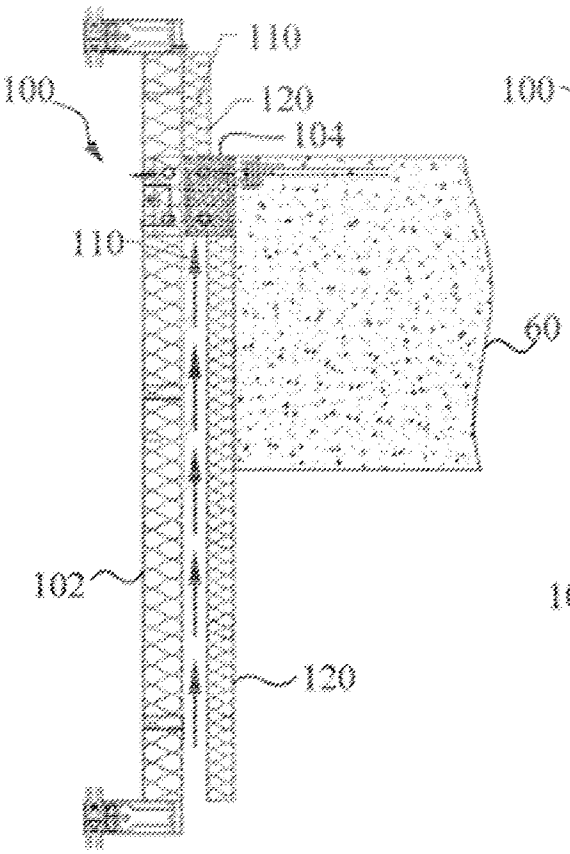
FIG. 4A is a side sectional view of an embodiment of a curtain wall insulation system, which illustrates a first step of installing a mullion cover on a mullion cover hanger.

As discussed above, the mullion cover hanger 110 can be attached to a mullion 52 (with fasteners, such as screws, or by welding) at a point above a floor slab 60 and at a point below the floor slab 60, where an installer has relatively open access for using electric tools, such as a power drill, electric screwdriver, or welder. After the mullion cover hanger 110 is installed on the mullion 52, an installer can easily attach the mullion cover 120 to the mullion cover hanger 110 without using electric tools, such as a power drill or electric screwdriver, or additional fasteners. The tool-less installation method of attaching a mullion cover 120 to the mullion cover hanger 110 is illustrated in FIGS. 4A-4C. As seen in FIG. 4A, the mullion cover 120 is slid into place between the floor slab 60 and the mullion cover hanger 110, as indicated by the directional arrows. Next, the mullion cover 120 is pressed onto the mullion cover hanger 110, as indicated by the directional arrows in FIG. 4B, so that the hook members of the mullion cover hanger 110 impale the mullion cover 120. If necessary, an installer may use an elongated handle (e.g., a broom handle) to help press the mullion cover 120 onto the mullion cover hanger 110. Although not required when using certain embodiments of the mullion cover hanger 110, the mullion cover 120 may be pulled downward to secure the mullion cover 120 in place, as indicated by the directional arrows in FIG. 4C. Alternatively, the mullion cover 120 may be attached to the mullion cover hanger 110 prior to installing the mullion cover hanger 110 on the mullion 52. Accordingly, the mullion cover hanger 110 allows the installation of mullion covers 120 in tight or otherwise obstructed spaces that are not readily accessible with electric tools or spaces in which the hand of an installer cannot reach.

The scope of the general inventive concepts presented herein are not intended to be limited to the particular exemplary embodiments shown and described herein. From the disclosure given, those skilled in the art will not only understand the general inventive concepts and their attendant advantages, but will also find apparent various changes and modifications to the devices and systems disclosed. It is sought, therefore, to cover all such changes and modifications as fall within the spirit and scope of the general inventive concepts, as described and/or claimed herein, and any equivalents thereof.

What is claimed is:

1. A curtain wall insulation system for insulating a curtain wall structure connected to a building structure, the curtain wall structure spaced from a floor slab of the building structure to define a perimeter void and the curtain wall structure having framing defined by at least first and second vertically disposed and parallel mullions, at least one upper horizontally disposed transom, and at least one lower horizontally disposed transom, the curtain wall insulation system comprising:

a curtain wall insulation disposed within the framing and attached to the framing;

a safing insulation disposed within the perimeter void and compression fit between the curtain wall insulation and the floor slab;

a mullion cover hanger attached to the mullions, the mullion cover hanger having:

a main body having a top surface, a bottom surface, a first side edge, and a second side edge; and a plurality of hook members extending outward relative to the top surface of the main body; and a mullion cover attached to the mullion cover hanger.

2. The curtain wall insulation system of claim 1, wherein a lower mullion cover is attached to the mullion cover hanger such that a top surface of the lower mullion cover abuts a bottom surface of the safing insulation, and an upper mullion cover is attached to the mullion cover hanger such that a bottom surface of the upper mullion cover abuts a top surface of the safing insulation.

3. The curtain wall insulation system of claim 1, further comprising a reinforcement member attached to and disposed between the mullions and behind the curtain wall insulation, and positioned at a level corresponding to a level of the safing insulation.

4. The curtain wall insulation system of claim 1, wherein a hook member positioned at a first side edge of the main body of the mullion cover hanger is parallel to a hook member positioned at a second side edge of the main body of the mullion cover hanger.

5. The curtain wall insulation system of claim 1, wherein an angle between each hook member and the top surface of the main body is 90°.

6. The curtain wall insulation system of claim 1, wherein the mullion cover hanger further comprises at least one fastening aperture that extends from the top surface of the main body through the bottom surface of the main body.

7. The curtain wall insulation system of claim 6, wherein at least one fastening aperture is positioned between the first side edge and a centerline of the main body, and at least one fastening aperture is positioned between the second side edge and a centerline of the main body.

8. The curtain wall insulation system of claim 1, wherein the hook members of the mullion cover hanger are defined by:

an upper edge that extends outward relative to the top surface of the main body at a first angle from the horizontal;

a lower edge that extends outward relative to the top surface of the main body at a second angle from the horizontal;

a topmost edge; and a hook edge;

wherein the upper edge terminates at the hook edge;

wherein the lower edge terminates at the topmost edge;

wherein the topmost edge extends toward the top surface of the main body and terminates at the hook edge; and wherein the first angle is less than the second angle.

9. The curtain wall insulation system of claim 8, wherein the first angle is 0° to 50° and the second angle is 20° to 70°.

10. The curtain wall insulation system of claim 8, wherein the first angle is 0° to 10° and the second angle is 20° to 40°.

11. The curtain wall insulation system of claim 1, wherein the hook members of the mullion cover hanger extend outward relative to the top surface of the main body by a distance of 1 inch to 2 inches.

* * * * *